US006079497A

United States Patent [19]

Johnston et al.

[11] Patent Number: 6,079,497

[45] Date of Patent: Jun. 27, 2000

[54] PRESSURE EQUALIZING SAFETY VALVE FOR SUBTERRANEAN WELLS

[75] Inventors: Russell A. Johnston, Alvin; Andrew J. Martin, Houston, both of Tex.

[73] Assignee: Camco International Inc., Houston, Tex.

[21] Appl. No.: 09/089,554

[22] Filed: Jun. 3, 1998

Related U.S. Application Data

[60] Provisional application No. 60/048,535, Jun. 3, 1997.

[51] Int. Cl.[7] ..... E21B 34/12

[52] U.S. Cl. ..... 166/324; 166/325; 166/332.7; 166/332.8

[58] Field of Search ..... 166/324, 332.7, 166/325, 332.8

[56] References Cited

U.S. PATENT DOCUMENTS

| | | |
|---|---|---|
| 19,013 | 1/1858 | Carr . |
| 709,262 | 9/1902 | Gold . |
| 1,655,729 | 1/1928 | Jones . |
| 1,783,621 | 12/1930 | Johnson . |
| 1,807,970 | 6/1931 | Davis . |
| 2,812,821 | 11/1957 | Nelson . |
| 2,839,082 | 6/1958 | Moore et al. . |
| 2,879,799 | 3/1959 | Jansen et al. . |
| 2,943,638 | 7/1960 | Prucha . |
| 3,075,539 | 1/1963 | Yoder . |
| 3,078,923 | 2/1963 | Tausch . |
| 3,196,699 | 7/1965 | Ipsen . |
| 3,382,895 | 5/1968 | McCollough . |
| 3,405,730 | 10/1968 | Baumann . |
| 3,442,484 | 5/1969 | Carr et al. . |
| 3,485,270 | 12/1969 | Freeman . |
| 3,631,888 | 1/1972 | Anton et al. . |
| 3,788,595 | 1/1974 | Colonna . |
| 3,799,204 | 3/1974 | Watkins et al. . |
| 3,804,124 | 4/1974 | Finke et al. . |
| 3,865,141 | 2/1975 | Young . |
| 3,870,079 | 3/1975 | Finke et al. . |
| 3,961,645 | 6/1976 | Kagan . |
| 3,971,438 | 7/1976 | Crowe . |
| 4,009,753 | 3/1977 | McGill et al. . |

(List continued on next page.)

FOREIGN PATENT DOCUMENTS

| | | |
|---|---|---|
| 74 12954 | 7/1975 | France . |
| 2504616C2 | 5/1984 | Germany . |
| 296883 | 3/1971 | U.S.S.R. . |
| 570698 | 11/1977 | U.S.S.R. . |
| 651120 | 3/1979 | U.S.S.R. . |
| 933955 | 6/1982 | U.S.S.R. . |
| 1063985A | 12/1983 | U.S.S.R. . |
| 1 461 641 | 1/1977 | United Kingdom . |
| 1 598 863 | 9/1981 | United Kingdom . |
| 2073288A | 10/1981 | United Kingdom . |
| 2115461A | 9/1983 | United Kingdom . |
| 2 292 959 | 3/1996 | United Kingdom . |

OTHER PUBLICATIONS

Thomas G. Hill, Jr. and Rashmi Bhavsar "Development of a Self–Equalizing Surface Controlled Subsurface Safety Valve for Reliability and Design Simplification" Offshore Technology Conference paper No. 8199, Houston, May 1996.

P.G.T. Mason "Downhole High–Pressure Equalizing Safety Valves: A Solution–Variable Labyrinth Seals" Offshore Technology Conference Paper No. 5526, Apr. 1987.

*Primary Examiner*—Roger Schoeppel
*Attorney, Agent, or Firm*—Tobor, Goldstein & Healey, LLP

[57] ABSTRACT

A subsurface safety valve having a valve member with a pressure equalizing mechanism is provided. The valve member includes a bore therethrough for receiving an equalizing plug. A beam is attached to the upper surface of the valve member for transferring downward motion of a flow tube to unseat the equalizing plug, and thereby establish fluid communication through the valve member prior to the opening of the valve member. A retention member is attached to the lower surface of the valve member to upwardly bias the equalizing plug within the plug bore of the valve member.

42 Claims, 10 Drawing Sheets

U.S. PATENT DOCUMENTS

| | | | |
|---|---|---|---|
| 4,161,219 | 7/1979 | Pringle . | |
| 4,252,197 | 2/1981 | Pringle . | |
| 4,308,894 | 1/1982 | Carpentier . | |
| 4,362,214 | 12/1982 | Pringle et al. . | |
| 4,373,587 | 2/1983 | Pringle . | |
| 4,411,316 | 10/1983 | Carmody . | |
| 4,415,036 | 11/1983 | Carmody et al. . | |
| 4,475,599 | 10/1984 | Akkerman . | |
| 4,478,286 | 10/1984 | Fineberg . | |
| 4,660,646 | 4/1987 | Blizzard . | |
| 4,976,317 | 12/1990 | Leismer . | |
| 5,310,004 | 5/1994 | Leismer . | |
| 5,503,229 | 4/1996 | Hill et al. . | |
| 5,682,921 | 11/1997 | Rawson et al. . | |
| 5,752,569 | 5/1998 | Bhavsar et al. | 166/324 |
| 5,884,705 | 3/1999 | Hill | 166/324 |

PRESSURE EQUALIZING SAFETY VALVE FOR SUBTERRANEAN WELLS

RELATED APPLICATIONS

This application claims the benefit of U.S. provisional application No. 60/048,535, filed Jun. 3, 1997.

BACKGROUND OF THE INVENTION

1. Field of the Invention

The present invention relates to a subsurface safety valve used for controlling fluid flow in a well conduit and, more particularly, to a pressure equalizing subsurface safety valve.

2. Description of the Related Art

Subsurface safety valves are commonly used in wells to prevent uncontrolled fluid flow through the well in the event of an emergency, such as to prevent a well blowout. Conventional safety valves use a flapper which is biased by a spring to a normally closed position, but is retained in an open position by the application of hydraulic fluid from the earth's surface. A typical subsurface safety valve is shown and described in U.S. Pat. No. 4,161,219, which is commonly assigned hereto.

When the flapper is in the closed position, well fluid pressure below the flapper acting upon a relatively large surface area of the flapper makes opening of the flapper difficult. This difficulty in opening cannot be easily overcome simply by increasing the force exerted against the flapper by an opening piston and cylinder assembly because the relatively small cross-sectional area of the opening piston and cylinder assembly would require a fluid pressure that may burst the control line carrying hydraulic fluid from the earth's surface to the piston and cylinder assembly. Additionally, when the flapper is opened the initial flow of well fluid is relatively rapid which tends to etch, or erode, the primary sealing surface of the flapper. Any damage to this primary sealing surface is extremely critical because it is this sealing surface which must be intact to prevent uncontrolled flow of well fluids and to prevent a possible well blow out. The present invention solves these difficulties by providing a subsurface safety valve with an equalizing mechanism to allow the pressure above and below the flapper to equalize prior to the complete opening of the flapper.

SUMMARY OF THE INVENTION

The present invention is directed generally to a subsurface safety valve with a pressure equalizing mechanism. In a broad aspect, the equalizing subsurface safety valve of the present invention includes a body member having a longitudinal bore extending therethrough; a valve actuator disposed for axial movement within the longitudinal bore; means for controllably moving the valve actuator within the longitudinal bore; a valve member mounted within the body member to control fluid flow through the longitudinal bore, the valve member having an upper surface, a lower surface, and a bore therethrough; means for biasing the valve member to a normally closed position to prevent fluid flow through the longitudinal bore; means for biasing the valve actuator away from the valve member; an equalizing plug disposed for reciprocal movement within the bore of the valve member for controlling fluid flow through the valve member; a retention member secured to the lower surface of the valve member for biasing the equalizing plug within the bore to a normally closed position; and a beam for transferring motion of the valve actuator to the equalizing plug; whereby downward movement of the valve actuator is transferred through the beam to the equalizing plug to shift the plug to open a passageway through the valve member and permit fluid pressure above and below the valve member to equalize before the valve member is opened to allow fluid flow through the longitudinal bore.

A further feature of the present invention is that the means for controllably moving the valve actuator within the longitudinal bore includes a piston and cylinder assembly mounted to the body member with one side of the assembly adapted to be in communication with a source of hydraulic fluid for moving the valve member to the open position to permit fluid flow through the longitudinal bore. Another feature of the present invention is that the valve member is a flapper valve. An additional feature of the present invention is that the valve member is a curved flapper valve. A further feature of the present invention is that the equalizing plug is a generally cylindrical plug having an enlarged annular sealing surface adjacent a first end thereof for cooperable sealing engagement with a sealing surface formed within the bore of the valve member. Another feature of the present invention is that the enlarged annular sealing surface further includes a metallic annular sealing surface. Another feature of the present invention is that the sealing surface within the bore of the valve member further includes an annular sealing surface. Another feature of the present invention is that the annular sealing surface within the bore of the valve member further includes a metallic portion and a pliable portion. Another feature of the present invention is that the equalizing plug includes an internal fluid flow passageway therethrough. Another feature of the present invention is that the internal fluid flow passageway includes a generally longitudinal passageway and at least one generally radially disposed opening, the generally longitudinal passageway extending from an upper portion of the plug and disposed in fluid communication with the at least one radially disposed opening, the at least one radially disposed opening exiting the plug at a location between the upper portion and the sealing surface of the equalizing plug. Another feature of the present invention is that the retention member includes first and second ends, the first end being secured to the lower surface of the valve member, and the second end being in contact with, and upwardly biasing, the equalizing plug within the bore of the valve member. Another feature of the present invention is that the first end of the equalizing plug includes a slot for receiving the second end of the retention member, the second end of the retention member being disposed within the slot. Another feature of the present invention is that the retention member traverses a portion of the valve member along a chord having a length less than the diameter of the valve member. Another feature of the present invention is that the retention member is a leaf spring. Another feature of the present invention is that the retention member is a simply supported spring. Another feature of the present invention is that the retention member is a spring-loaded washer. Another feature of the present invention is that the lower surface of the valve member includes a recessed slot for receiving the retention member, the retention member being disposed within the recessed slot.

Another feature of the present invention is that the valve actuator travels in a downward path, and the beam is a cantilevered arm having a first end and a second end, the first end being secured to the upper surface of the valve member, the second end being disposed within the downward path of the valve actuator, and a portion of the beam being positioned directly above the equalizing plug. Another feature of the present invention is that the beam includes an aperture adjacent the upper portion of the equalizing plug, the aperture and the plug cooperating to establish fluid communication between the longitudinal bore above the valve member and the longitudinal bore below the valve member. Another feature of the present invention is that the aperture has a size and configuration whereby fluid communication may be established between the longitudinal bore above the valve member and the longitudinal bore below the valve member, and there being sufficient contact between the beam and the upper portion of the plug to enable the beam to shift the plug downwardly. Another feature of the present invention is that the beam includes more than one aperture. Another feature of the present invention is that the width of the beam is less than the diameter of a generally longitudinal passageway through the equalizing plug, whereby fluid communication may be established around the beam and into the longitudinal bore above the valve member, and there being sufficient contact between the beam and the upper portion of the plug to enable the beam to shift the plug downwardly. Another feature of the present invention is that the upper surface of the beam includes a concave surface for mating with the valve actuator when the valve member is in a fully open position, the radius of the concave surface being substantially equal to the radius of the outer surface of the valve actuator. Another feature of the present invention is that the beam traverses a portion of the valve member along a chord having a length less than the diameter of the valve member. Another feature of the present invention is that the upper surface of the valve member further includes a recessed slot for receiving the beam, the beam being disposed within the recessed slot.

Another feature of the present invention is that the valve actuator travels in a downward path, and the beam is a cantilevered arm having a first end, a second end, and an actuating member, the first end being secured to the upper surface of the valve member, the second end being disposed within the downward path of the valve actuator, and the actuating member extending into the bore of the valve member and having a lower surface resting upon an upper surface of the equalizing plug. Another feature of the present invention is that the upper surface of the equalizing plug is disposed below the upper surface of the valve member. Another feature of the present invention is that the valve member further includes a recessed slot in its upper surface for receiving the beam, the recessed slot having a lower surface, and the upper surface of the equalizing plug being disposed below the lower surface of the recessed slot. Another feature of the present invention is that the beam includes an aperture extending longitudinally through the actuating member, the aperture and the equalizing plug cooperating to establish fluid communication between the longitudinal bore above the valve member and the longitudinal bore below the valve member. Another feature of the present invention is that the beam includes more than one aperture. Another feature of the present invention is that the width of the beam is less than the diameter of a generally longitudinal passageway through the plug, whereby fluid communication may be established from the plug passageway around the beam and into the longitudinal bore above the valve member.

The equalizing means of the present invention may also be incorporated into a curved flapper valve. In this aspect, the present invention includes a body member having a longitudinal bore extending therethrough; a valve actuator disposed for axial movement within the longitudinal bore; means for controllably moving the valve actuator within the longitudinal bore; a curved flapper valve mounted within the body member to control fluid flow through the longitudinal bore, the curved flapper valve having a concave upper surface, a convex lower surface, a bore therethrough, and a longitudinal axis, the concave upper surface having a sealing surface about its periphery; means for biasing the curved flapper valve to a normally closed position to prevent fluid flow through the longitudinal bore; means for biasing the valve actuator away from the valve member; an equalizing plug disposed for reciprocal movement within the bore of the curved flapper valve for controlling fluid flow through the curved flapper valve; a retention member secured to the lower surface of the curved flapper valve for biasing the equalizing plug within the bore of the curved flapper valve to a normally closed position; and a beam for transferring motion of the valve actuator to the equalizing plug; whereby downward movement of the valve actuator is transferred through the beam to the equalizing plug to shift the plug to open a passageway through the curved flapper valve and permit fluid pressure above and below the curved flapper valve to equalize before the curved flapper valve is opened to allow fluid flow through the longitudinal bore.

Another feature of the present invention is that the means for controllably moving the valve actuator within the longitudinal bore includes a piston and cylinder assembly mounted to the body member with one side of the assembly adapted to be in communication with a source of hydraulic fluid for moving the curved flapper valve to the open position to permit fluid flow through the longitudinal bore. Another feature of the present invention is that the equalizing plug is a generally cylindrical plug having an enlarged annular sealing surface adjacent a first end thereof for cooper able sealing engagement with a sealing surface formed within the bore of the curved flapper valve. Another feature of the present invention is that the enlarged annular sealing surface includes a metallic annular sealing surface. Another feature of the present invention is that the sealing surface within the bore of the curved flapper valve includes an annular sealing surface. Another feature of the present invention is that the annular sealing surface within the bore of the curved flapper valve further includes a metallic portion and a pliable portion. Another feature of the present invention is that the equalizing plug includes an internal fluid flow passageway therethrough. Another feature of the present invention is that the internal fluid flow passageway includes a generally longitudinal passageway and at least one generally radially disposed opening, the generally longitudinal passageway extending from an upper portion of the plug and disposed in fluid communication with the at least one generally radially disposed opening, the at least one radially disposed opening exiting the plug at a location between the upper portion and the sealing surface of the equalizing plug. Another feature of the present invention is that the retention member includes a first end, a second end, and a longitudinal axis, the first end being secured to the lower surface of the curved flapper valve, and the second end being in contact with, and upwardly biasing, the equalizing plug within the bore through the curved flapper valve. Another feature of the present invention is that a first end of the equalizing plug includes a slot for receiving the second end of the retention member, the second end of the retention member being disposed within the slot. Another feature of the present invention is that the longitudinal axis of the retention member is aligned parallel to, and directly beneath, the longitudinal axis of the curved flapper valve. Another feature of the present invention is that the longitudinal axis of the retention member is aligned perpendicular to the longitudinal axis of the curved flapper valve, and the retention member has a radius of curvature which conforms to the convex lower surface of the curved flapper valve. Another feature of the present invention is that the retention member is a leaf spring. Another feature of the present invention is that the retention member is a simply supported spring. Another feature of the present invention is that the retention member is a spring-loaded washer. Another feature of the present invention is that the lower surface of the curved flapper valve includes a recessed slot for receiving the retention member, the retention member being disposed within the recessed slot.

Another feature of the present invention is that the valve actuator travels in a downward path, and the beam is a cantilevered arm having a first end, a second end, and a longitudinal axis, the first end being secured to the upper surface of the curved flapper valve, the second end being disposed within the downward path of the valve actuator, and a portion of the beam being positioned directly above the equalizing plug. Another feature of the present invention is that the beam further includes an aperture adjacent the upper portion of the equalizing plug, the aperture and the plug cooperating to establish fluid communication between the longitudinal bore above the curved flapper valve and the longitudinal bore below the curved flapper valve. Another feature of the present invention is that the aperture has a size and configuration whereby fluid communication may be established between the longitudinal bore above the curved flapper valve and the longitudinal bore below the curved flapper valve, and there being sufficient contact between the beam and the upper portion of the plug to enable the beam to shift the plug downwardly. Another feature of the present invention is that the beam includes more than one aperture. Another feature of the present invention is that the width of the beam is less than the diameter of a generally longitudinal passageway through the plug, whereby fluid communication may be established around the beam and into the longitudinal bore above the curved flapper valve, and there being sufficient contact between the beam and the upper portion of the plug to enable the beam to shift the plug downwardly. Another feature of the present invention is that the longitudinal axis of the beam is aligned parallel to, and overlies, the longitudinal axis of the curved flapper valve. Another feature of the present invention is that the longitudinal axis of the beam is aligned perpendicular to the longitudinal axis of the curved flapper valve, and the beam has a radius of curvature which conforms to the concave upper surface of the curved flapper valve. Another feature of the present invention is that the concave surface of the curved flapper valve includes a recessed slot for receiving the beam, the beam being disposed within the recessed slot. Another feature of the present invention is that the valve actuator travels in a downward path, and the beam includes a cantilevered arm having a first end, a second end, an actuating member, and a longitudinal axis, the first end being secured to the concave surface of the curved flapper valve, the second end being disposed within the downward path of the valve actuator, and the actuating member extending into the bore through the curved flapper valve and having a lower surface resting upon an upper surface of the equalizing plug. Another feature of the present invention is that the upper surface of the equalizing plug is disposed below the concave surface of the curved flapper valve. Another feature of the present invention is that the curved flapper valve includes a recessed slot in its concave surface for receiving the beam, the recessed slot having a lower surface, and the upper surface of the equalizing plug being disposed below the lower surface of the recessed slot. Another feature of the present invention is that the beam includes an aperture extending longitudinally through the actuating member, whereby the aperture and the equalizing plug cooperate to establish fluid communication between the longitudinal bore above the curved flapper valve and the longitudinal bore below the curved flapper valve. Another feature of the present invention is that the beam includes more than one aperture. Another feature of the present invention is that the width of the beam is less than the diameter of a generally longitudinal passageway through the plug, whereby fluid communication may be established from the plug passageway around the beam and into the longitudinal bore above the curved flapper valve. Another feature of the present invention is that the longitudinal axis of the beam is aligned parallel to, and overlies, the longitudinal axis of the curved flapper valve.

Another feature of the present invention is that the equalizing subsurface safety valve further includes a nose member mounted to the body member within the longitudinal bore below the curved flapper valve, the nose member including an upper contoured sealing surface, the valve actuator further including a lower contoured surface for mating with the sealing surface on the curved flapper valve when the curved flapper valve is in its closed position and with the upper contoured sealing surface on the nose member when the curved flapper valve is in its open position. Another feature of the present invention is that the safety valve further includes an it upstanding biasing member attached to the nose member to urge the curved flapper valve toward its closed position after hydraulic pressure is removed and the flow tube is retracted upwardly.

Another feature of the present invention is that the upstanding biasing member is a leaf spring.

DETAILED DESCRIPTION OF THE INVENTION

For purposes of the following description, it will be assumed that the present invention is installed within a subsurface safety valve of the type shown in U.S. Pat. No. 4,161,219, which type is commonly referred to as a rod-piston safety valve. However, it should be understood that the present invention can be used in any commercially available safety valve, whether it be tubing conveyed, wireline conveyed, hydraulically operated, or electrically operated.

Figure 1:
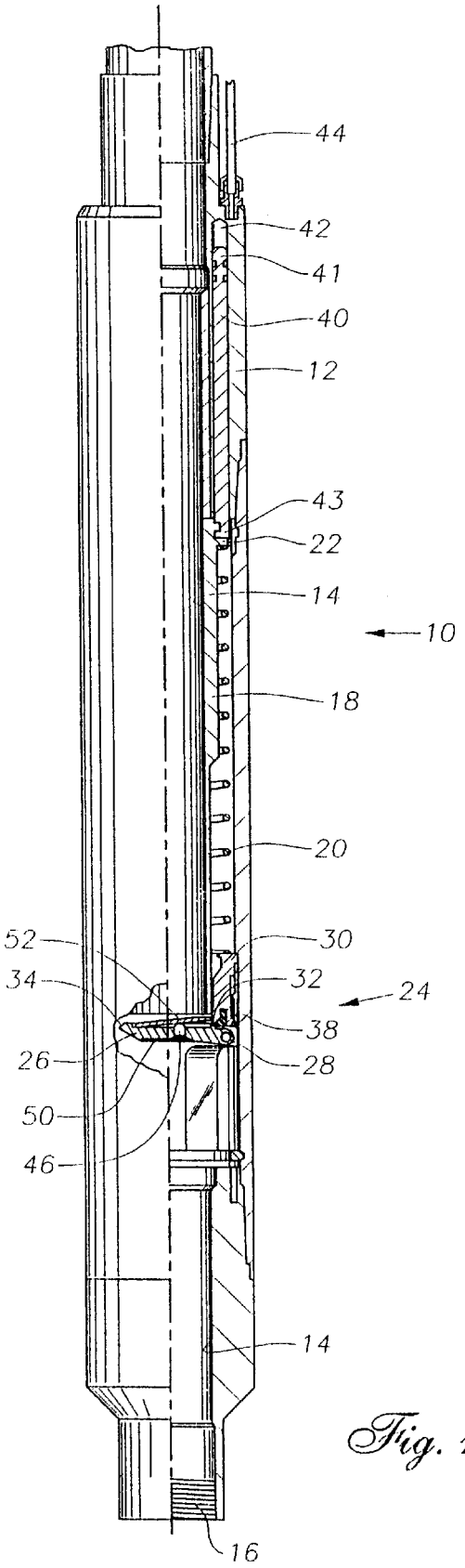
FIG. 1 is an elevational side view, partially in cross-section, showing a subsurface safety valve of the present invention.

Referring to the drawings in detail, wherein like numerals denote identical elements throughout the several views, there is shown in FIG. 1 a specific embodiment of a subsurface safety valve 10 constructed in accordance with the present invention. With reference to FIG. 1, the subsurface safety valve 10 of this specific embodiment is comprised of a generally tubular body 12 with a longitudinal bore 14 that extends therethrough. Each end of the body 12 includes mechanisms, such as threads 16, for interconnection with a pipe string (not shown) suspended within a wellbore (not shown). A sleeve member 18, usually referred to as a flow tube, is disposed within the bore 14 and is adapted for axial movement therein. The flow tube 18 includes a spring 20 disposed therearound that acts upon a shoulder 22 on the flow tube 18 biasing the flow tube 18 away from a flapper mechanism 24. The present invention is not intended to be limited to any particular means for biasing the flow tube 18 away from the flapper 24. For example, instead of, or in addition to, the spring 20, the valve 10 may utilize a balancing gas chamber (not shown), such as those disclosed in U.S. Pat. No. 4,252,197 (Pringle), U.S. Pat. No. 4,660,646 (Blizzard), U.S. Pat. No. 4,976,317 (Leismer), and U.S. Pat. No. 5,310,004 (Leismer), all of which are commonly assigned hereto and incorporated herein by reference.

Figure 2:
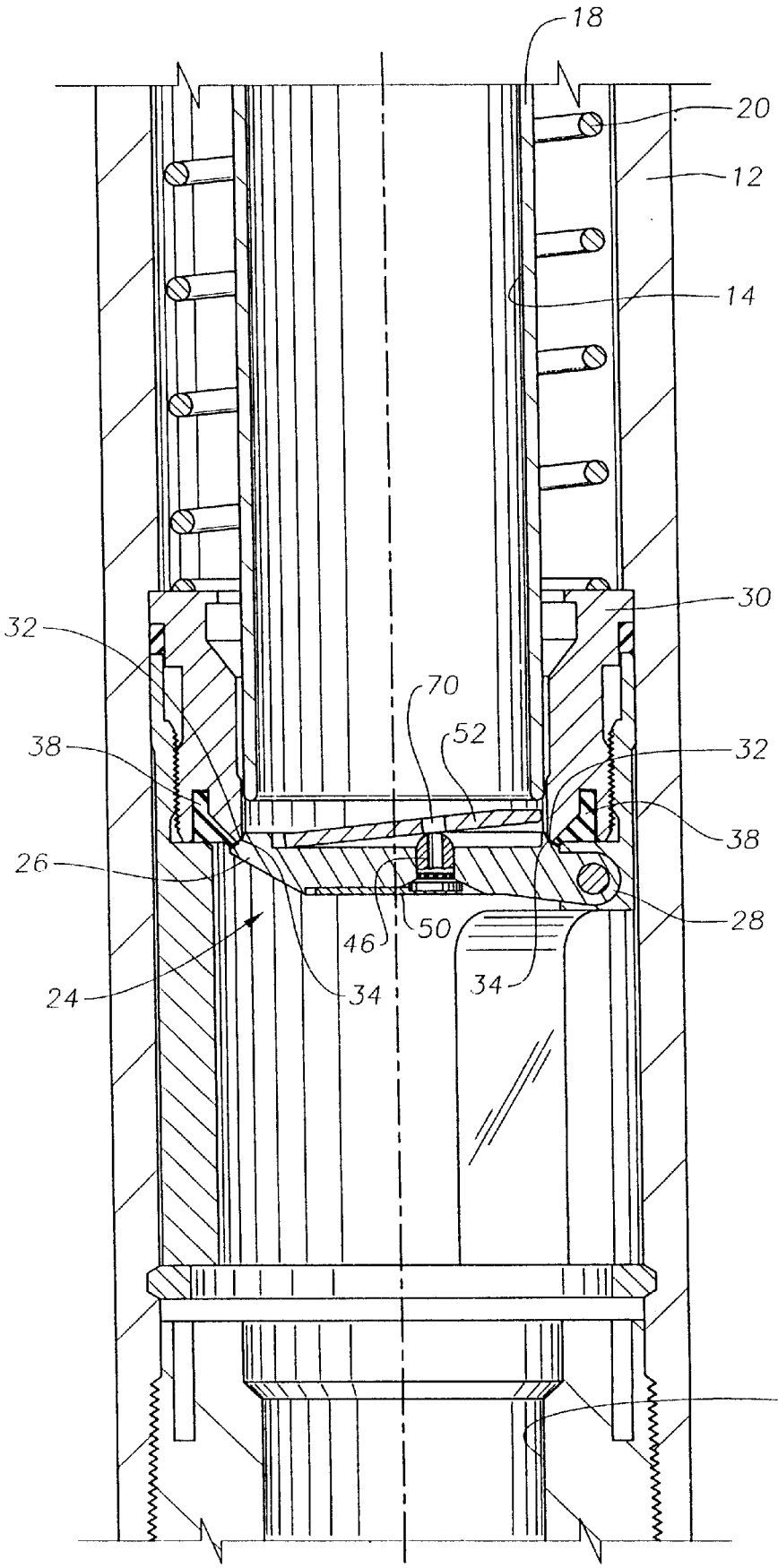
FIG. 2 is an elevational side view, in cross-section, showing an equalizing mechanism of the present invention installed in the flapper mechanism of the subsurface safety valve shown in FIG. 1, with both the flapper mechanism and the equalizing mechanism in closed positions.
Figure 3:
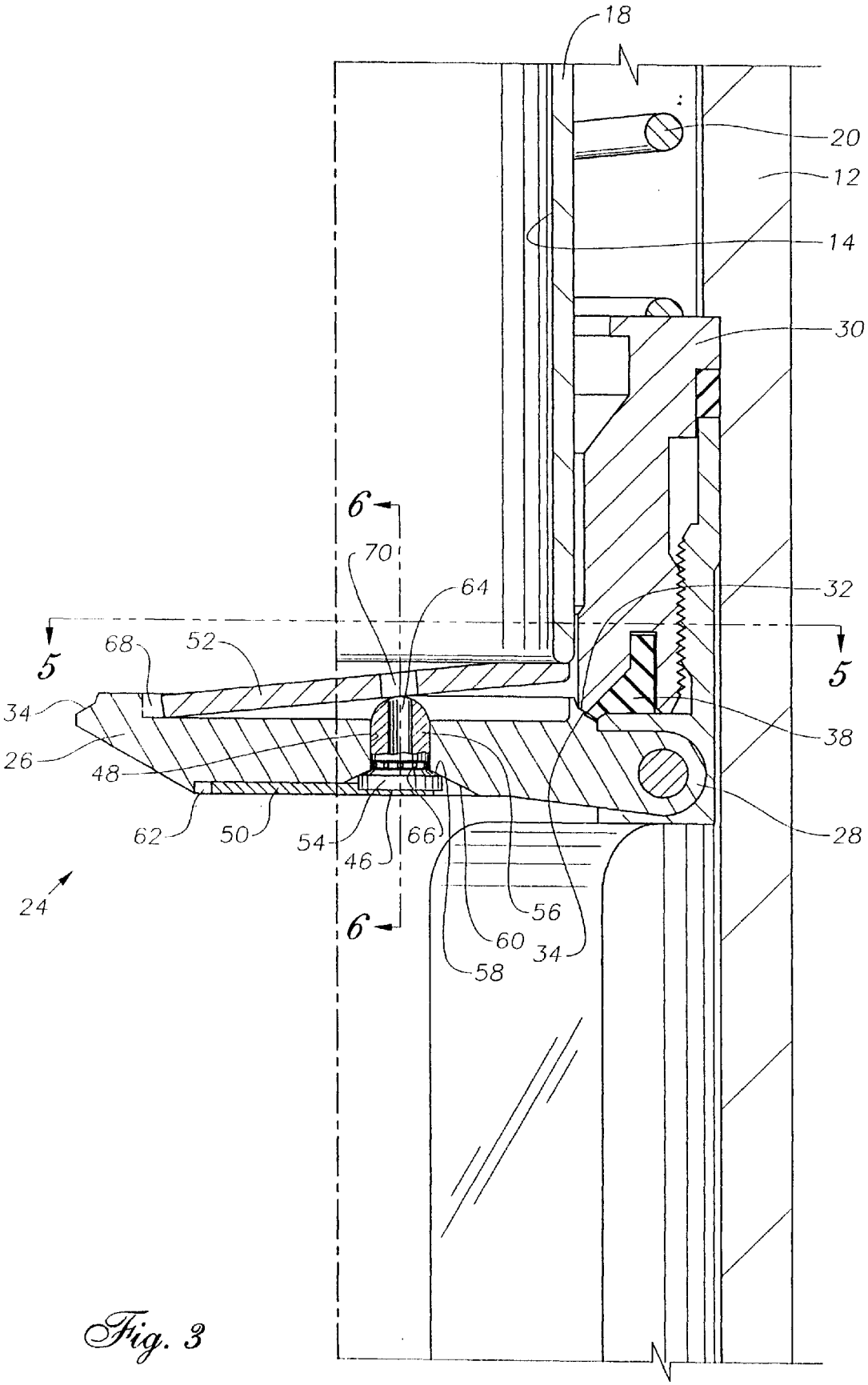
FIG. 3 is a fragmentary elevational view, similar to FIG. 2, showing an equalizing mechanism of the present invention installed in the flapper mechanism of the subsurface safety valve shown in FIG. 1, with both the flapper mechanism and the equalizing mechanism in closed positions.
Figure 4:
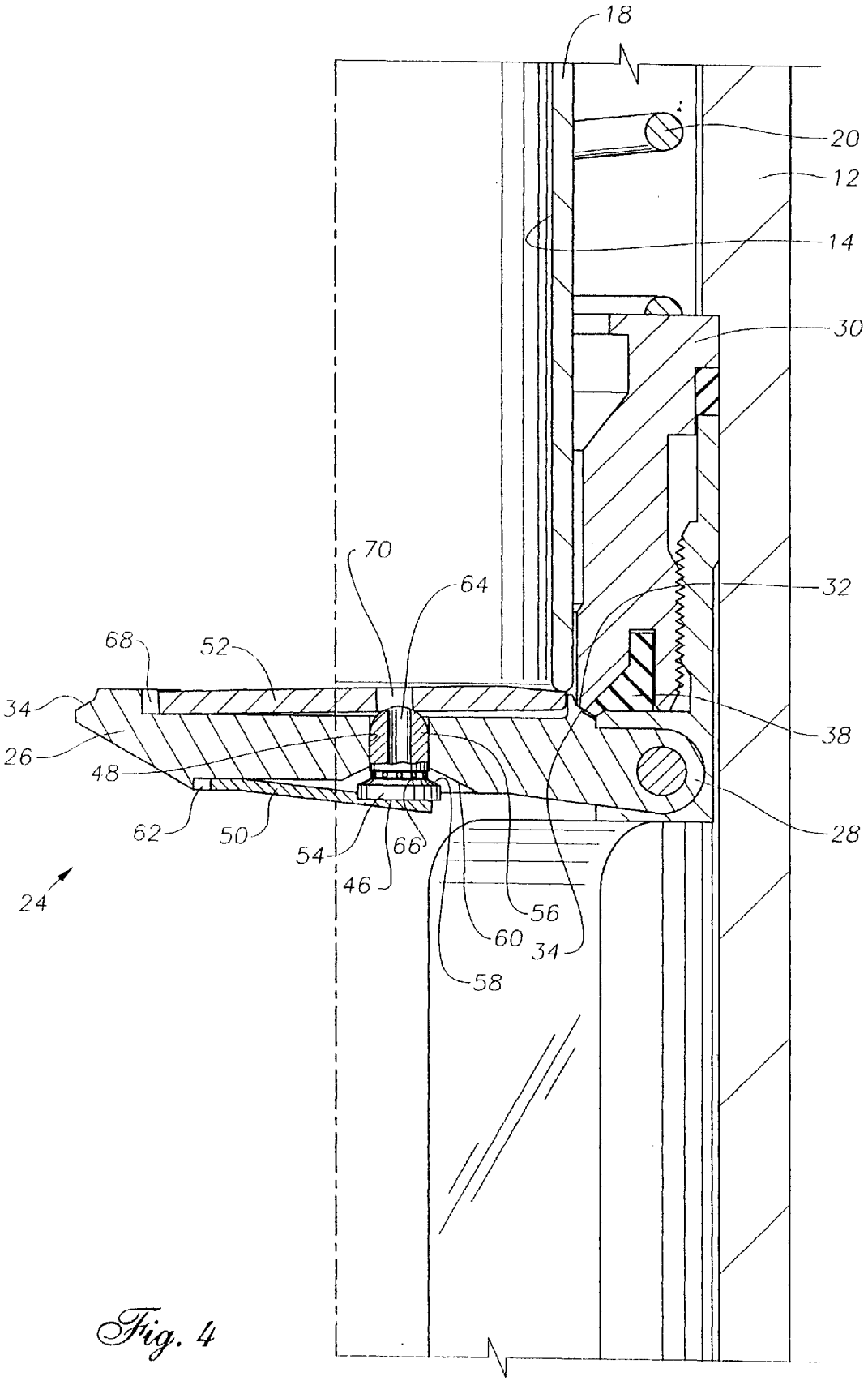
FIG. 4 is a fragmentary elevational view, similar to FIG. 3, except that a flow tube has now moved downwardly to displace the equalizing mechanism of the present invention into an equalizing position.

Referring to FIGS. 2–4, the flapper mechanism 24 generally comprises a disc or flapper valve closure member 26 with an arm 28 on a peripheral edge thereof that is hingedly connected to an annular housing 30 mounted within the bore 14. In a specific embodiment, the annular housing 30 includes a metallic annular sealing surface 32 cooperable with an annular sealing surface 34 on the flapper 26. In a specific embodiment, the annular housing 30 may further include a secondary annular sealing surface 38 formed from an annular body of pliable material, which is cooperable with the annular sealing surface 34 on the flapper 26. The metallic sealing surface 32 is generally referred to as the "hard seat" and the pliable sealing surface 38 is generally referred to as the "soft seat".

As shown in FIG. 1, in a specific embodiment, a rod-piston system may be provided to open the flapper 26, and may be comprised of a piston 40 sealably mounted for reciprocal movement within a cylinder 42 located within the wall of the tubular body 12. A first end 41 of the piston 40 is in contact with hydraulic fluid (not shown) provided thereto from the earth's surface through a relatively small diameter control conduit 44. A second end 43 of the piston 40 is operatively connected, in any suitable manner, to the flow tube 18. When the pressure of hydraulic fluid in the control conduit 44 exceeds the force needed to compress the spring 20, the piston 40 is forced downwardly, thereby causing the flow tube 18 to come into contact with, and open, the flapper 26. In the event that the hydraulic pressure applied to the piston 40 is decreased, as by command from the earth's surface or by the control conduit 44 being damaged, the spring 20 forces the flow tube 18 upwardly away from the flapper 26. The flapper 26 is then rotated, and biased, into a closed position by action of a hinge spring (not shown) to permit the annular sealing surfaces 32, 34 and 38 to mate and thereby establish a fluid seal to prevent fluid flow into the flow tube 18.

As has been described above, when the flapper 26 has been closed, the pressure of fluids within the bore 14 upstream of (i.e., below) the closed flapper 26 increases and the pressure of the wellbore fluids downstream of (i.e., above) the closed flapper 26 decreases as the wellbore fluids remaining above the flapper 26 are recovered to the earth's surface through the pipe string. This creates a large pressure differential across the flapper 26 such that reopening of the flapper 26 becomes difficult. This difficulty in opening the flapper 26 cannot be easily overcome simply by increasing the force exerted against the lower surface of the flapper 26, because the relatively small cross-sectional area of the opening piston 40 and cylinder 42 would require a fluid pressure that may burst the control conduit 44 carrying the hydraulic fluid. The present invention solves this difficulty in opening the flapper 26 by providing the flapper mechanism 24 with a pressure equalizing mechanism, described below, to allow the pressure above and below the flapper 26 to equalize prior to the complete opening of the flapper 26, thereby reducing the force necessary to open the flapper 26.

Referring to FIGS. 2–4, in a specific embodiment of the present invention, the flapper mechanism 24 is provided with a pressure equalizing mechanism which includes: an equalizing plug 46; a bore 48 through the flapper 26 for receiving the plug 46; a retention member 50 secured to the lower surface of the flapper 26 for upwardly biasing the equalizing plug 46 within the bore 48; and a beam 52 secured to the upper surface of the flapper 26 for transferring the downward movement of the flow tube 18 to the plug 46 to thereby shift the plug 46 axially downwardly to open a passageway through the flapper 26 and permit the fluid pressure above and below the flapper 26 to equalize.

Figure 5:
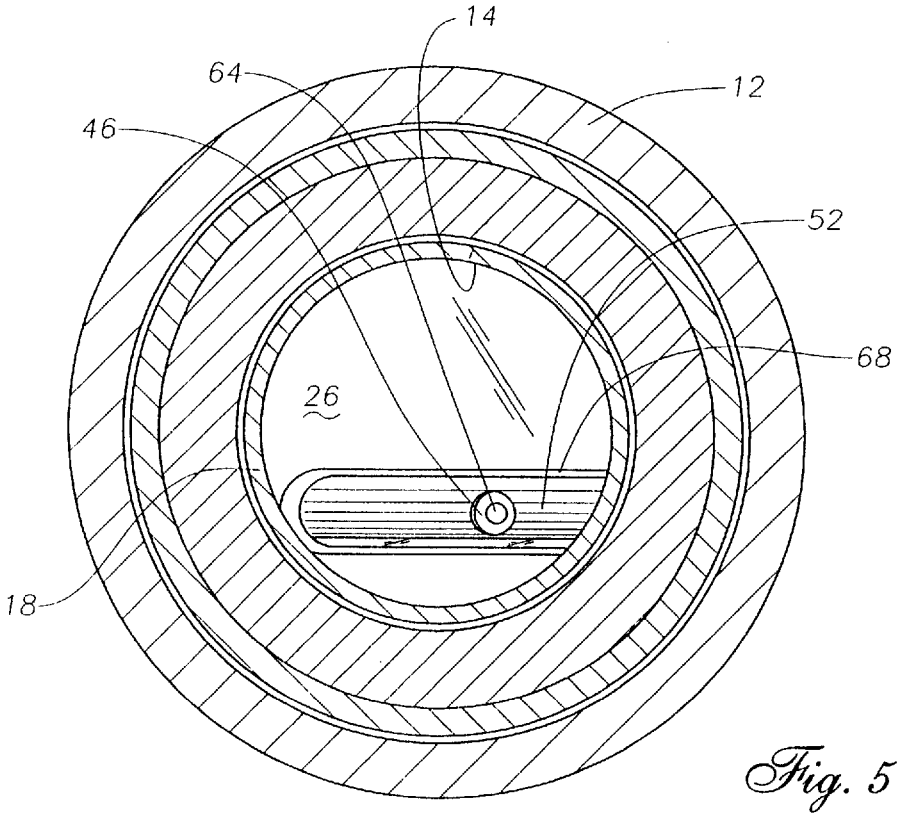
FIG. 5 is a cross-sectional view taken along line 5—5 of FIG. 3 showing a top view of the flapper mechanism in the closed position.

The plug 46 is disposed for reciprocal movement within the plug bore 48. In a specific embodiment, as shown in FIG. 5, the plug bore 48 may be positioned between the center and the periphery of the flapper 26. As shown in FIGS. 3 and 4, the plug 46 includes an enlarged shoulder 54 on a first end thereof and an upper portion 56 on an opposite second end thereof.

Figure 7:
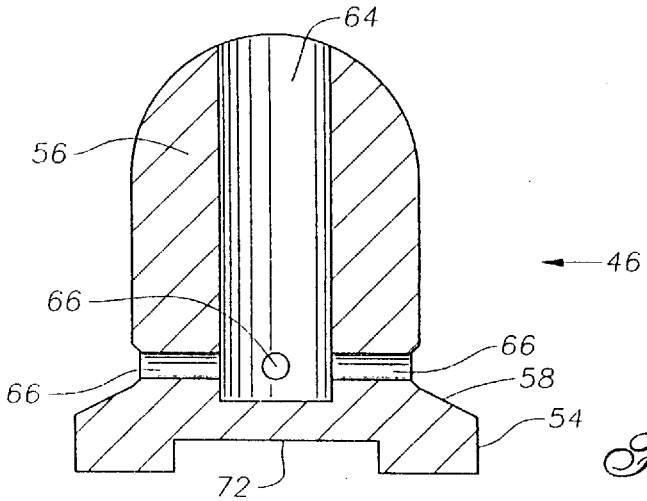
FIG. 7 is an enlarged cross-sectional view of the plug as shown in FIG. 6.

The enlarged shoulder 54 includes a metallic annular sealing surface 58 that cooperates with a metallic annular sealing surface 60 (or "hard seat") on the flapper 26 about the plug bore 48. In a specific embodiment, the bore 48 of the flapper 26 may also include a secondary annular sealing surfaces (or "soft seat") (not shown) formed from an annular body of pliable material to cooperate with a mating secondary annular sealing surface (not shown) on the enlarged shoulder 54 of the plug 46. Preferably, a soft seat is used to ensure sealing when operating in low pressure differential applications. The plug 46 includes an internal fluid flow passageway. As best shown FIG. 7, in a specific embodiment, the internal fluid flow passageway through the plug 46 includes a passageway 64 and one or more generally radially disposed openings 66. The passageway 64 preferably extends longitudinally from the upper portion 56 of the plug 46 and is disposed in fluid communication with the one or more radially disposed openings 66. The one or more radially disposed openings 66 exit the plug 46 at a location between the upper portion 56 and the sealing surface 58. The purpose of the longitudinal passageway 64 and one or more radially disposed openings 66 will be described below. In a specific embodiment, the first end of the plug 46 may be provided with a slot 72 for receiving the retention member 50.

As shown in FIG. 3, the plug 46 is held in a normally closed position by action of the retention member 50. In a specific embodiment, the retention member 50 may be a cantilevered beam which is fastened at a first end thereof to the lower surface of the flapper 26. Alternatively, the retention member 50 may be a simply supported spring or a leaf spring (not shown). The opposite second end of the retention member 50 may be received within the slot 72 in the first end of the equalizing plug 46. In a specific embodiment, the lower surface of the flapper 26 may be provided with a recessed slot 62 for receiving the retention member 50. In yet another specific embodiment, the retention member 50 may be a spring-loaded washer (not shown), such as a Belleville spring. In a specific embodiment, the retention member 50 may traverse a portion of the flapper 26 along a chord having a length less than the diameter of the flapper 26.

The beam 52 is fastened at a first end thereof to the upper surface of the flapper 26, and the opposite or second end of the beam 52 extends into the path of the flow tube 18. A portion of the beam 52 is positioned directly above the equalizing plug 46. In a specific embodiment, the upper surface of the flapper 26 may be provided with a recessed slot 68 for receiving the beam 52. In a relaxed state, the beam 52 rests upon the upper portion 56 of the equalizing plug 46. In a specific embodiment, the beam 52 may be provided with an aperture 70 adjacent the upper portion 56 of the plug 46. The aperture 70 should cooperate with the plug 46 so that fluid communication may be established between the longitudinal bore 14 above the flapper 26 and the longitudinal bore 14 below the flapper 26. There should be sufficient contact between the beam 52 and the upper portion 56 of the plug 46 so that the beam 52 will shift the plug 46 downwardly. Alternatively, the beam 52 may be provided with a plurality of apertures or slots (not shown), instead of a single aperture 70, so long as the plurality of apertures meet the above-identified size and configuration requirements. In another specific embodiment, instead of providing one or more apertures in the beam 52 to establish fluid communication from the passageway 64, the beam 52 may alternatively be provided with a width smaller than the diameter of the passageway 64. In this manner, fluid communication from the passageway 64 to the bore 14 above the flapper valve 26 may be established around the beam 52 instead of through any aperture in it.

Figure 6:
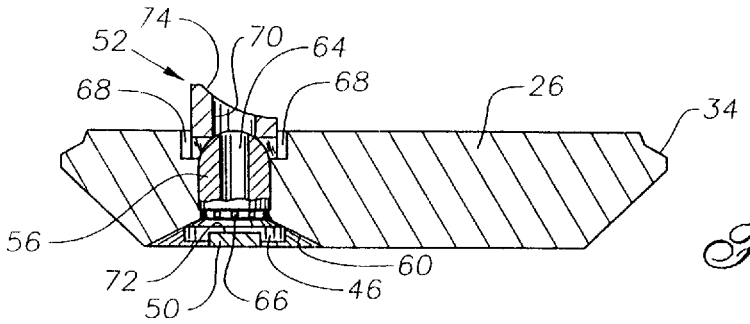
FIG. 6 is a cross-sectional view taken along line 6—6 of FIG. 3 showing an elevational side view of the flapper mechanism with the equalizing mechanism of the present invention in a closed position, and showing the concave upper surface of the cantilevered beam.
Figure 9:
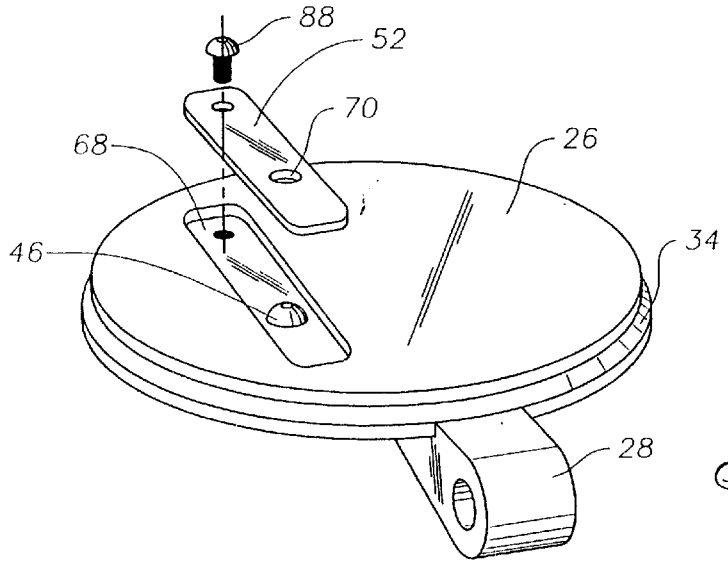
FIG. 9 is a perspective, partially exploded, view of the flapper mechanism of the present invention detached from the subsurface safety valve.
Figure 10:
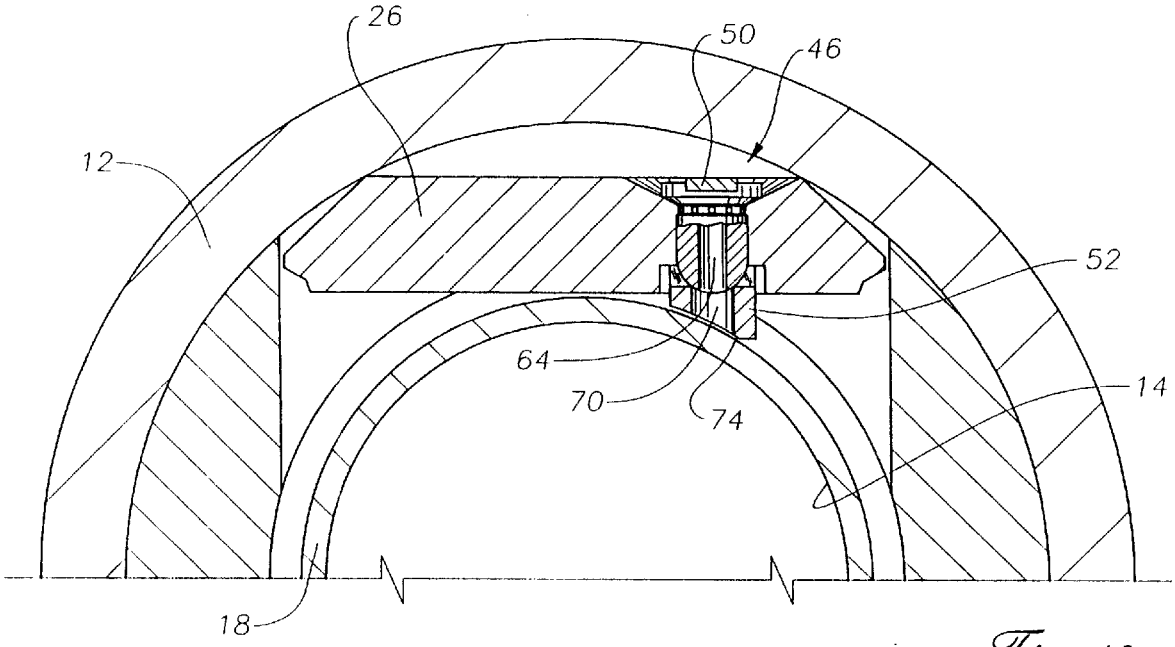
FIG. 10 is a sectional view taken along line 10—10 of FIG. 8 showing the flapper mechanism in its open position.

As best shown in FIGS. 6 and 10, the top of the beam 52 may be provided with a concave surface 74 for mating with the flow tube 18 when the flapper 26 is in its fully open position. In this embodiment, the radius of the concave surface 74 should be substantially equal to the radius of the outer surface of the flow tube 18. In another specific embodiment, as shown in FIG. 9, the top of the beam 52 may be flat. In a specific embodiment, as best shown in FIGS. 5–6 and 9–10, the beam 52 may traverse a portion of the flapper 26 along a chord having a length less than the diameter of the flapper 26. The first end of the beam 52 may be connected to the upper surface of the flapper 26 in any manner as known to those of ordinary skill in the art, such as by a screw 88, as shown in FIG. 9. In another specific embodiment, the beam 52 may be secured to the plug 46 and the first end of the beam 52 may be slidably secured within a slot (not shown) in the upper surface of the flapper 26. In another specific embodiment, the beam 52 may be a cantilevered arm.

When the flapper 26 and equalizing plug 46 are both in their closed positions, as shown in FIGS. 2 and 3, and it is desired to open the flapper 26, the flow tube 18 is forced towards the flapper 26 by the application of hydraulic fluid through the control conduit 44 (as has been described previously) or by electrical/mechanical action or simply mechanical action, depending upon the type of safety valve within which the present invention is included. With reference to FIG. 4, as the flow tube 18 is moved downwardly, a lower portion of the flow tube 18 will come into contact with the second end of the beam 52. The lower portion of the flow tube 18 is formed from material sufficiently hard to not be deformed, or galled, by contact with the beam 52, or the lower portion of the flow tube 18 can include a surface hard coating or can be formed as a separate piece joined thereto and formed from harder material than the other portions of the flow tube 18. As the second end of the beam 52 is pushed downwardly, the beam 52 will shift the plug 46 axially downwardly so as to separate the annular sealing surfaces 58 and 60 and expose the one or more radially disposed openings 66. Due to the mechanical advantage provided by the beam 52, the force that must be imparted to the flow tube 18, by application of hydraulic fluid through the control conduit 44, to shift the plug 46 downwardly is reduced. The relatively high pressure wellbore fluid below the flapper 26 then rapidly flows into the one or more radially disposed openings 66, through the passageway 64, through the aperture 70 in the beam 52, and into the bore 14 above the flapper 26. Since the radially disposed openings 66 are displaced from the annular sealing surfaces 58 and 60, the relatively rapid flow of wellbore fluids will not damage the sealing surfaces 58 and 60. In this manner, a fluid flow passageway is opened through the flapper 26, thereby permitting the fluid pressure above and below the flapper 26 to equalize.

Figure 8:
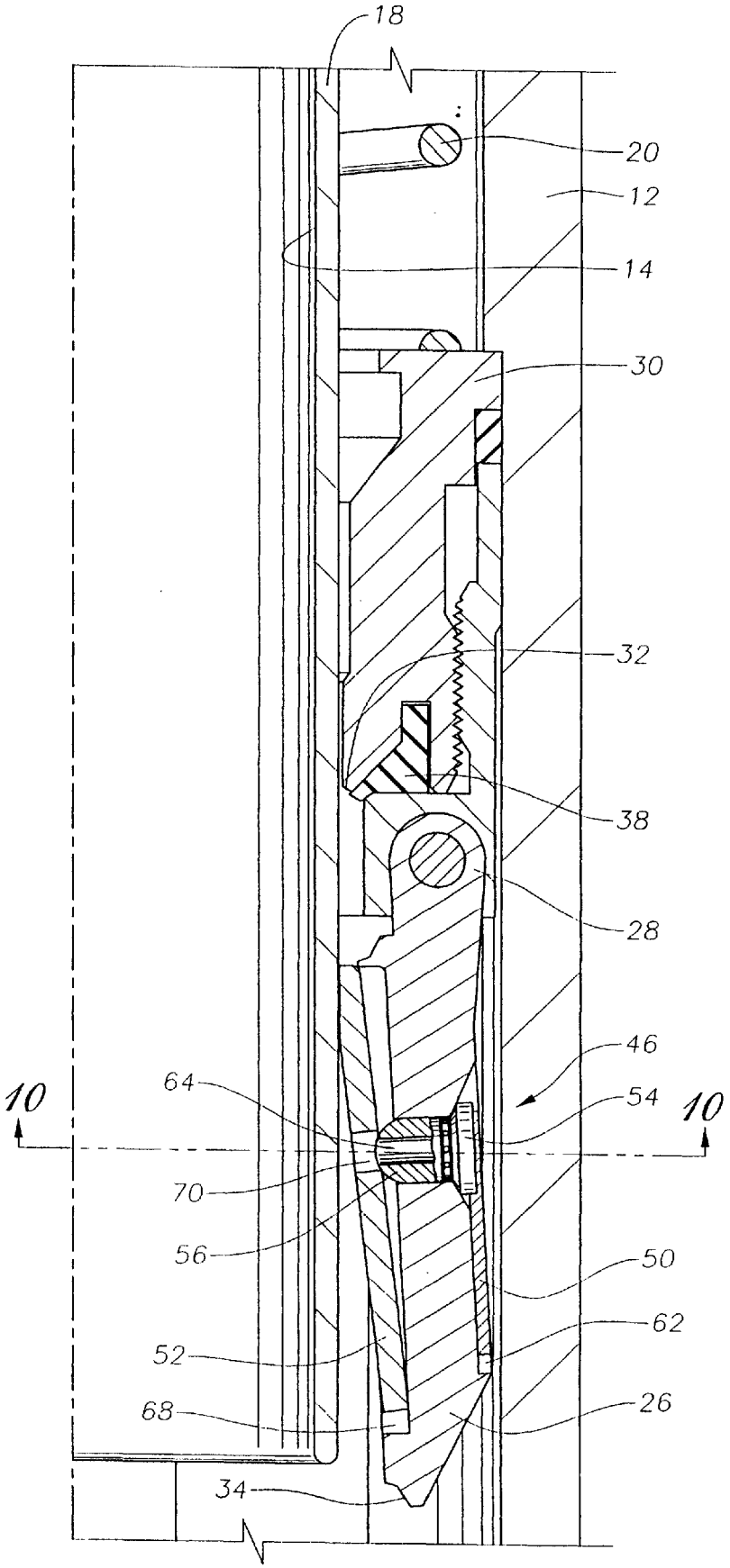
FIG. 8 is a fragmentary elevational view similar to FIGS. 3 and 4 showing the flapper mechanism of the present invention in an open position and the equalizing mechanism of the present invention in its closed position.

In operation, the flow tube 18 travels axially downward, activating the equalizing mechanism and coming to rest against the flapper 26 until the pressure equalization has occurred, and then proceeds with the opening of the flapper 26. In this manner, the pressure differential across the flapper 26 is equalized through the plug 46 prior to the opening of the flapper 26. As such, the equalizing mechanism of the present invention prevents the initial relatively high velocity flow of fluids past the flapper 26 from damaging the annular sealing surfaces 32, 34, and 38. To complete the opening of the flapper 26, the flow tube 18 is forced against the flapper 26 with sufficient force to overcome the force exerted by the hinge spring (not shown), the force exerted by the spring 20, and the force exerted by the pressure in the tubing, and hold the flapper 26 in the open position, as shown in FIGS. 8 and 10, as long as the hydraulic pressure from the control conduit 44 is applied. When the flapper 26 is in the open position, the plug 46 is maintained by the retention member 50 in its closed or sealed position. In this manner, excessive exposure of the sealing surfaces 58 and 60 to production fluids is prevented. When the hydraulic pressure from the control conduit 44 is reduced or removed, the spring 20 causes the flow tube 18 to be moved away from the flapper 26, so that: (a) the flapper 26 rotates to a closed position and the sealing surfaces 32, 34 and 38 come into operative contact with each other to prevent fluid flow therepast; and (b) the flow tube 18 moves away from the second end of the beam 52 so that the plug 46 is upwardly biased into the plug bore 48 by the retention member 50, the radially disposed openings 66 are closed, and the sealing surfaces 58 and 60 come into operative contact with each other to prevent fluid flow therepast. During the closing of the flapper 26, the equalizing plug 46 may be opened for a very brief time, but will return to the closed position as soon as there ceases to be contact between the beam 52 and the flow tube 18.

Figure 11:
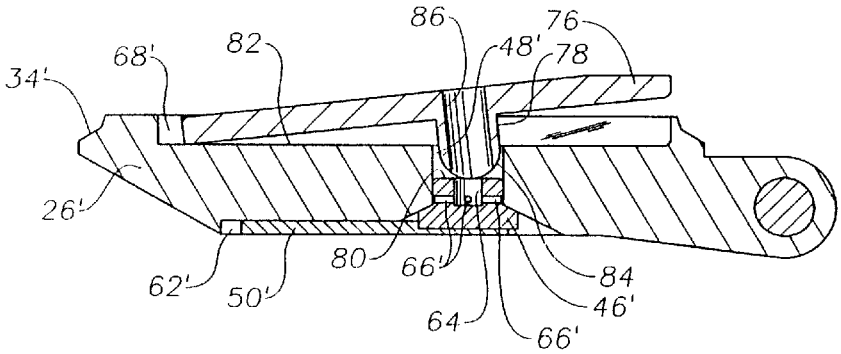
FIG. 11 is a sectional view similar to FIG. 3 showing an elevational side view of a flapper mechanism with an alternative embodiment of a cantilevered beam and equalizing plug.

In another specific embodiment, as shown in FIG. 11, the flapper 26' may be provided with a beam 76 having an actuating member 78 extending into the plug bore 48'. In this embodiment, the upper surface 80 of the equalizing plug 46' is located below the lower surface 82 of the recessed slot 68' in the top of the flapper 26'. The actuating member 78 on the beam 76 is provided with a lower surface 84 which, in a relaxed state, rests upon the upper surface 80 of the equalizing plug 46'. In a specific embodiment, the beam 76 may be provided with an aperture 86 extending longitudinally through the actuating member 78. As with the aperture 70 of the beam 52 shown in FIGS. 2–6, the aperture 86 of the present embodiment must have a size and configuration such that fluid communication may be established between the longitudinal bore 14 above the flapper 26 and the longitudinal bore 14 below the flapper 26. More particularly, fluid communication is established from the one or more radially disposed openings 66' and passageway 64' of the plug 46' through the aperture 86. Alternatively, the beam 76 may be provided with a plurality of apertures (not shown), instead of a single aperture 86, so long as the plurality of apertures meets the above-identified size and configuration requirement. In another specific embodiment, instead of providing one or more apertures in the beam 76 to establish fluid communication through the flapper 26, the beam 76 may alternatively be provided with a width smaller than the diameter of the passageway 64' in the plug 46'. In this manner, fluid communication from the passageway 64' to the bore 14' above the flapper valve 26' may be established around the beam 76 instead of through any aperture in it.

Figure 12:
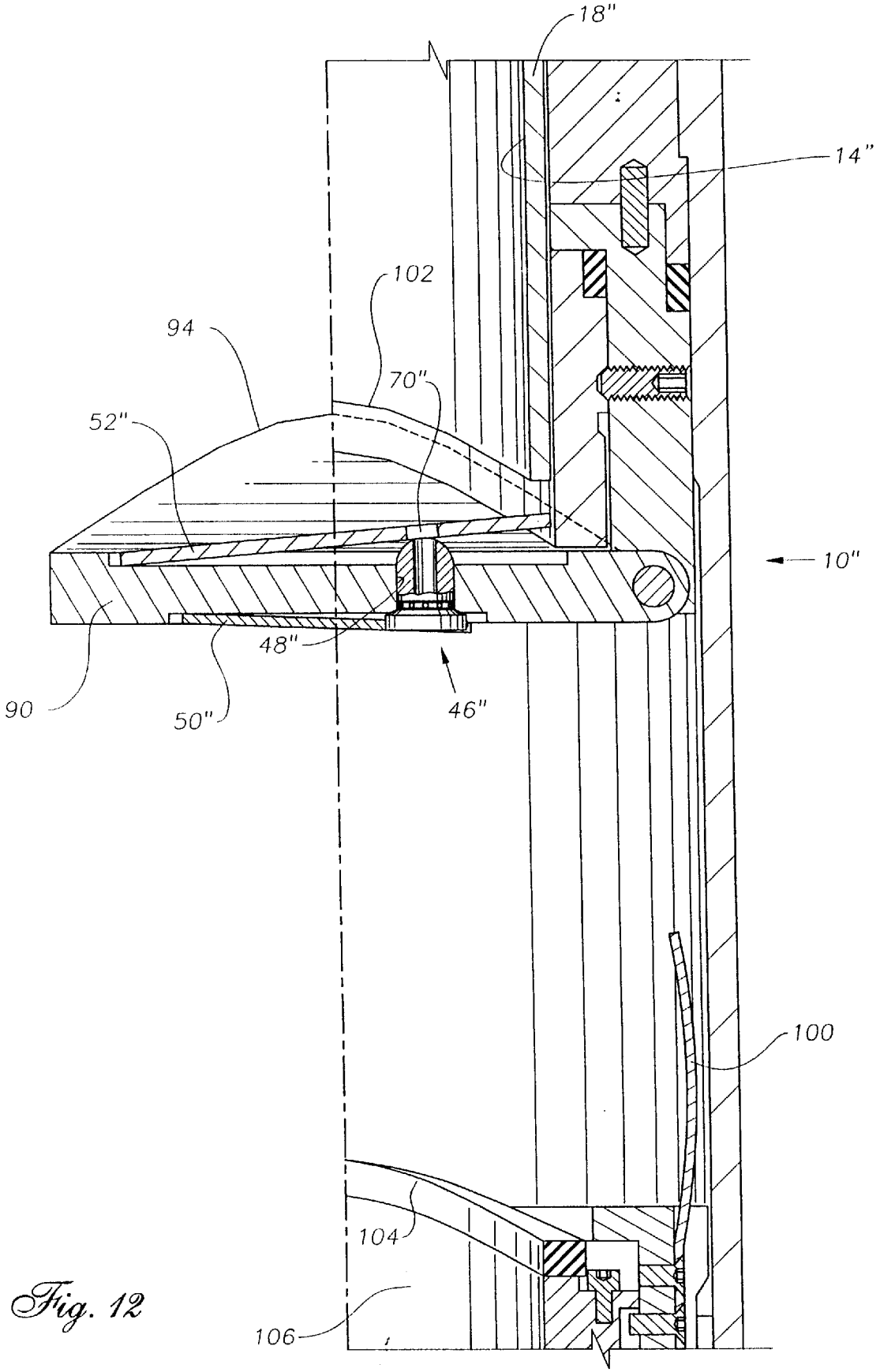
FIG. 12 is an elevational side view, in cross-section, showing an equalizing mechanism of the present invention installed in a curved flapper valve, mounted within a subsurface safety valve similar to the one shown in FIG. 1, with both the curved flapper valve and the equalizing mechanism in closed positions.
Figure 13:
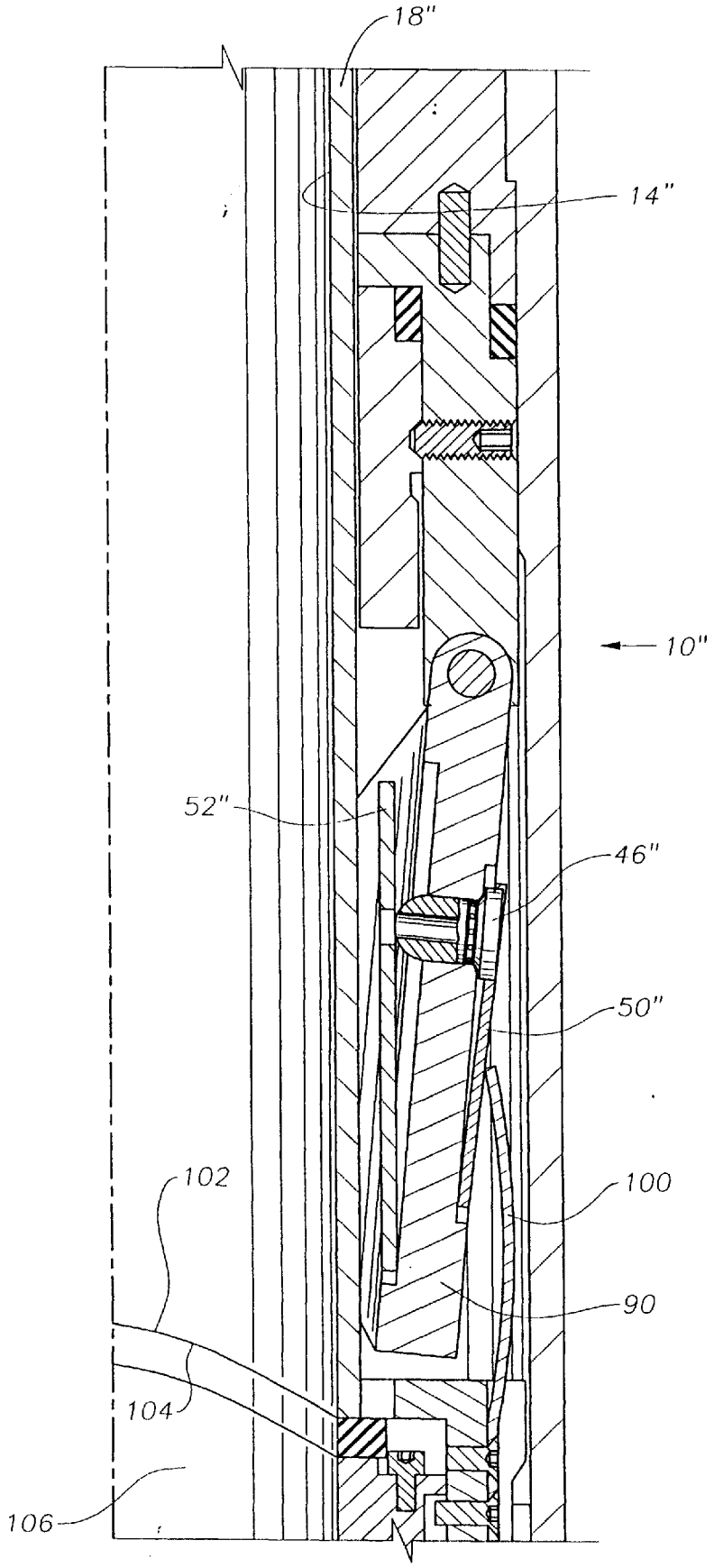
FIG. 13 is an elevational side view, in cross-section, similar to FIG. 12, showing the curved flapper valve in its open position, and the equalizing mechanism in its closed position.
Figure 14:
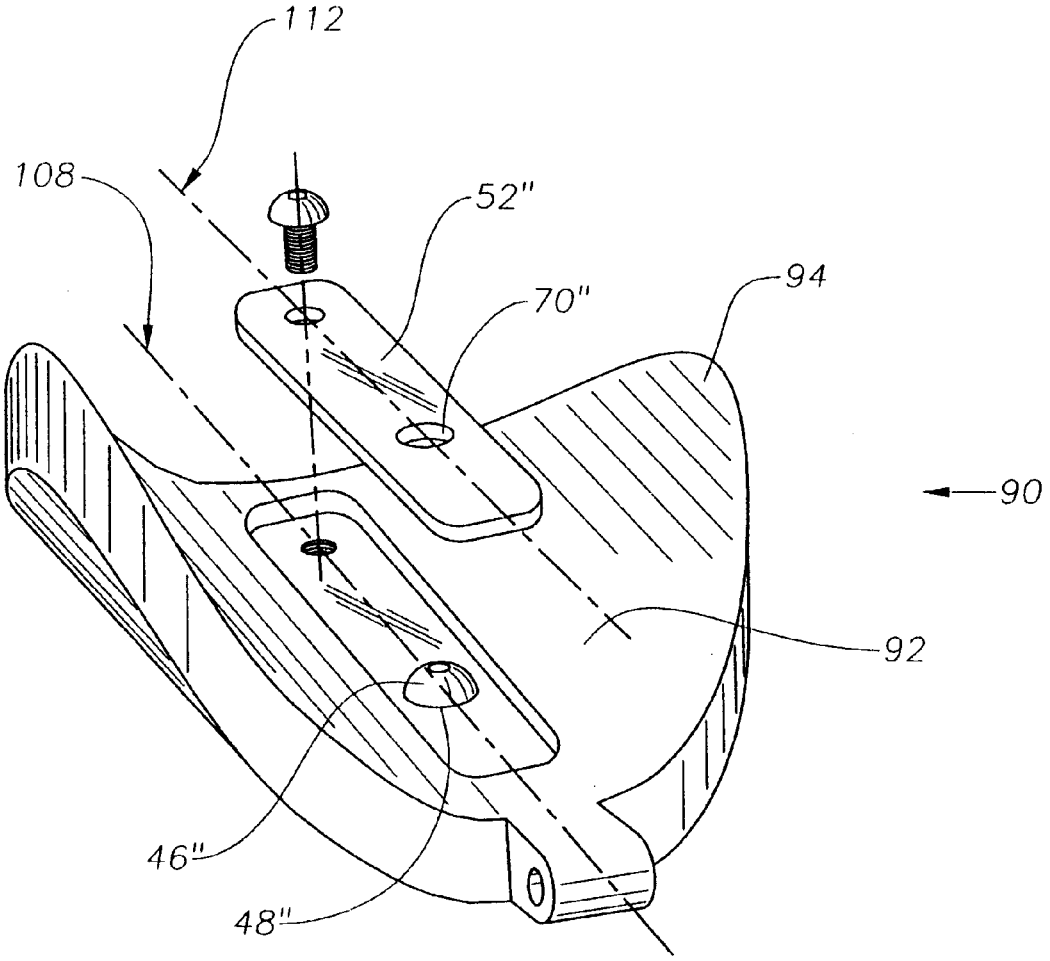
FIG. 14 is a perspective, partially exploded, view of the equalizing mechanism of the present invention installed in a curved flapper valve.

With reference to FIGS. 12–14, in another specific embodiment, the equalizing mechanism of the present invention may be installed within a curved flapper valve 90 of the type disclosed in U.S. Pat. No. 4,926,945, commonly assigned hereto, which is incorporated herein by reference. A curved flapper valve, such as valve 90, is used in a subsurface safety valve 10" to provide a smaller outside diameter of the safety valve 10", as compared to its outside diameter when using a flat flapper valve 26, as shown in FIGS. 1–11. By decreasing the outside diameter of the safety valve, the curved flapper valve 90 allows for deployment in smaller diameter wellbores. With reference to FIG. 14, the curved flapper valve 90 includes: a concave upper surface 92 having a sealing surface 94 about its periphery; a plug bore 48" therethrough; and a longitudinal axis 108.

With reference to FIG. 12, the curved flapper valve 90 is provided with a pressure equalizing mechanism as disclosed hereinabove. More particularly, the curved flapper valve 90 is provided with: an equalizing plug 46" disposed for reciprocal movement within the plug bore 48" of the curved flapper valve 90 for controlling fluid flow through the curved flapper valve 90; a retention member 50" secured to the lower convex surface of the curved flapper valve 90, for upwardly biasing the equalizing plug 46" within the bore 48"; and a beam 52" secured to the upper surface of the curved flapper valve 90 for transferring downward movement of the flow tube 18" to the plug 46" to thereby shift the plug 46" axially downwardly to open a passageway through the curved flapper valve 90 and permit the fluid pressure above and below the curved flapper valve 90 to equalize. The structure and operation of the equalizing mechanism in the curved flapper valve 90 is substantially the same as is described above in connection with the flat flapper valve 26. One difference, however, as best shown in FIG. 14, is that the beam 52" is preferably secured to the concave surface 92 of the curved flapper 90 such that its longitudinal axis 112 is aligned parallel to, and overlies, the longitudinal axis 108 of the curved flapper valve 90. Similarly, in a specific embodiment, the retention member 50" is preferably secured to the lower convex surface of the curved flapper 90 such that its longitudinal axis is aligned parallel to, and directly beneath, the longitudinal axis 108 of the curved flapper valve 90. Alternatively, the beam 52" may be secured to the concave surface 92 of the curved flapper 90 such that its longitudinal axis 112 is aligned perpendicular to the longitudinal axis 108 of the curved flapper valve 90 (not shown). In this embodiment, the beam 52" (not shown) is provided with a radius of curvature which conforms to the radius of curvature of the concave upper surface 92 of the curved flapper valve 90. The retention member 50" may be similarly attached to the lower convex surface of the curved flapper valve 90.

Referring to FIGS. 12 and 13, in this embodiment, as more fully explained in U.S. Pat. No. 4,926,945, the lower end of the flow tube 18" is provided with a contoured surface 102 for mating with the sealing surface 94 on the curved flapper valve 90 when the valve 90 is in the closed position, as shown in FIG. 12. When the curved flapper valve 90 is in the open position, as shown in FIG. 13, the contoured surface 102 on the lower end of the flow tube 18" seals against a mating contoured sealing surface 104 on a nose member 106 mounted below the curved flapper valve 90 within the longitudinal bore 14 of the safety valve 10", as more fully explained in U.S. Pat. No. 4,926,945. Still referring to FIG. 13, in a specific embodiment of the present invention, an upstanding biasing member 100 may be attached to the nose 106 to urge the curved flapper valve 90 toward its closed position after hydraulic pressure is removed from the control conduit 44 (FIG. 1) and the flow tube 18" is retracted upwardly. In a specific embodiment, the upstanding biasing member 100 may be a leaf spring.

It is to be understood that the invention is not limited to the exact details of construction, operation, exact materials or embodiments shown and described, as obvious modifications and equivalents will be apparent to one skilled in the art. Accordingly, the invention is therefore to be limited only by the scope of the appended claims.

We claim:

1. An equalizing subsurface safety valve for controlling fluid flow in a well conduit, comprising:

a body member having a longitudinal bore extending therethrough;

a valve actuator disposed for axial movement within the longitudinal bore;

a piston disposed within the body member and moveable in response to application of hydraulic fluid to move the valve actuator within the longitudinal bore;

a valve member mounted within the body member to control fluid flow through the longitudinal bore, the valve member having an upper surface, a lower surface, and a bore therethrough;

means for biasing the valve actuator away from the valve member;

an equalizing plug disposed for reciprocal movement within the bore of the valve member;

a retention member secured to the lower surface of the valve member and biasing the equalizing plug within the bore to a normally closed position; and, a cantilevered beam having a first end and a second end, the first end being secured to the upper surface of the valve member, the second end being disposed within the downward path of the valve actuator, and a portion of the beam being positioned directly above the equalizing plug, whereby downward movement of the valve actuator is transferred through the beam to the equalizing plug to shift the plug to open a passageway through the valve member and permit fluid pressure above and below the valve member to equalize before the valve member is opened to allow fluid flow through the longitudinal bore.

2. The equalizing subsurface safety valve of claim 1, wherein the means for biasing the valve actuator away from the valve member is a spring.

3. The equalizing subsurface safety valve of claim 1, wherein the means for biasing the valve actuator away from the valve member is a balancing gas chamber.

4. The equalizing subsurface safety valve of claim 1, wherein the equalizing plug is a generally cylindrical plug having an internal fluid flow passageway therethrough and an enlarged annular sealing surface adjacent a first end thereof for cooperable sealing engagement with a sealing surface formed within the bore of the valve member.

5. The equalizing subsurface safety valve of claim 4, wherein the enlarged annular sealing surface on the plug further includes a pliable annular sealing surface.

6. The equalizing subsurface safety valve of claim 4, wherein the sealing surface formed within the bore of the valve member further includes a pliable annular sealing surface.

7. The equalizing subsurface safety valve of claim 4, wherein the internal fluid flow passageway includes a generally longitudinal passageway and at least one generally radially disposed opening, the generally longitudinal passageway extending from an upper portion of the plug and disposed in fluid communication with the at least one radially disposed opening, the at least one radially disposed opening exiting the plug at a location between the upper portion and the sealing surface of the equalizing plug.

8. The equalizing subsurface safety valve of claim 1, wherein the beam includes at least one aperture adjacent the upper portion of the equalizing plug, the at least one aperture and the plug cooperating to establish fluid communication between the longitudinal bore above the valve member and the longitudinal bore below the valve member.

9. The equalizing subsurface safety valve of claim 8, wherein the aperture has a size and configuration whereby fluid communication may be established between the longitudinal bore above the valve member and the longitudinal bore below the valve member, and there being sufficient contact between the beam and the upper portion of the plug to enable the beam to shift the plug downwardly.

10. The equalizing subsurface safety valve of claim 1, wherein the upper surface of the beam includes a concave surface for mating with the valve actuator when the valve member is in a fully open position, the radius of the concave surface being substantially equal to the radius of the outer surface of the valve actuator.

11. The equalizing subsurface safety valve of claim 1, wherein the beam further includes an actuating member extending into the bore of the valve member and having a lower surface resting upon an upper surface of the equalizing plug.

12. The equalizing subsurface safety valve of claim 11, wherein the upper surface of the equalizing plug is disposed below the upper surface of the valve member.

13. The equalizing subsurface safety valve of claim 11, wherein the beam includes at least one aperture extending longitudinally through the actuating member, the at least one aperture and the equalizing plug cooperating to establish fluid communication between the longitudinal bore above the valve member and the longitudinal bore below the valve member.

14. An equalizing subsurface safety valve for controlling fluid flow in a well conduit, comprising:

a body member having a longitudinal bore extending therethrough;

a valve actuator disposed for axial movement within the longitudinal bore;

a piston disposed within the body member and moveable in response to application of hydraulic fluid to move the valve actuator within the longitudinal bore;

a valve member mounted within the body member to control fluid flow through the longitudinal bore, the valve member having an upper surface, a lower surface, and a bore therethrough;

a spring for biasing the valve actuator away from the valve member;

an equalizing plug disposed for reciprocal movement within the bore of the valve member;

a retention member secured to the lower surface of the valve member and biasing the equalizing plug within the bore to a normally closed position; and, a cantilevered beam having a first end and a second end, the first end being secured to the upper surface of the valve member, the second end being disposed within the downward path of the valve actuator, and a portion of the beam being positioned directly above the equalizing plug, whereby downward movement of the valve actuator is transferred through the beam to the equalizing plug to shift the plug to open a passageway through the valve member and permit fluid pressure above and below the valve member to equalize before the valve member is opened to allow fluid flow through the longitudinal bore.

15. The equalizing subsurface safety valve of claim 14, further including a balancing gas chamber to assist the spring in biasing the valve actuator away from the valve member.

16. The equalizing subsurface safety valve of claim 14, wherein the equalizing plug is a generally cylindrical plug having an internal fluid flow passageway therethrough and an enlarged annular sealing surface adjacent a first end thereof for cooperable sealing engagement with a sealing surface formed within the bore of the valve member.

17. The equalizing subsurface safety valve of claim 16, wherein the enlarged annular sealing surface on the plug further includes a pliable annular sealing surface.

18. The equalizing subsurface safety valve of claim 16, wherein the sealing surface formed within the bore of the valve member further includes a pliable annular sealing surface.

19. The equalizing subsurface safety valve of claim 16, wherein the internal fluid flow passageway includes a generally longitudinal passageway and at least one generally radially disposed opening, the generally longitudinal passageway extending from an upper portion of the plug and disposed in fluid communication with the at least one radially disposed opening, the at least one radially disposed opening exiting the plug at a location between the upper portion and the sealing surface of the equalizing plug.

20. The equalizing subsurface safety valve of claim 14, wherein the beam includes at least one aperture adjacent the upper portion of the equalizing plug, the at least one aperture and the plug cooperating to establish fluid communication between the longitudinal bore above the valve member and the longitudinal bore below the valve member.

21. The equalizing subsurface safety valve of claim 20, wherein the aperture has a size and configuration whereby fluid communication may be established between the longitudinal bore above the valve member and the longitudinal bore below the valve member, and there being sufficient contact between the beam and the upper portion of the plug to enable the beam to shift the plug downwardly.

22. The equalizing subsurface safety valve of claim 14, wherein the upper surface of the beam includes a concave surface for mating with the valve actuator when the valve member is in a fully open position, the radius of the concave surface being substantially equal to the radius of the outer surface of the valve actuator.

23. The equalizing subsurface safety valve of claim 16, wherein the beam further includes an actuating member extending into the bore of the valve member and having a lower surface resting upon an upper surface of the equalizing plug.

24. The equalizing subsurface safety valve of claim 23, wherein the upper surface of the equalizing plug is disposed below the upper surface of the valve member.

25. The equalizing subsurface safety valve of claim 23, wherein the beam includes at least one aperture extending longitudinally through the actuating member, the at least one aperture and the equalizing plug cooperating to establish fluid communication between the longitudinal bore above the valve member and the longitudinal bore below the valve member.

26. An equalizing subsurface safety valve for controlling fluid flow in a well conduit, comprising:

a body member having a longitudinal bore extending therethrough;

a valve actuator disposed for axial movement within the longitudinal bore;

a piston disposed within the body member and moveable in response to application of hydraulic fluid to move the valve actuator within the longitudinal bore;

a valve member mounted within the body member to control fluid flow through the longitudinal bore, the valve member having an upper surface, a lower surface, and a bore therethrough;

means for biasing the valve actuator away from the valve member;

an equalizing plug disposed for reciprocal movement within the bore of the valve member;

retaining means secured to the lower surface of the valve member for biasing the equalizing plug within the bore to a normally closed position; and, beam means for transferring downward movement of the valve actuator to the equalizing plug to shift the plug to open a passageway through the valve member and permit fluid pressure above and below the valve member to equalize before the valve member is opened to allow fluid flow through the longitudinal bore.

27. The equalizing subsurface safety valve of claim 26, wherein the means for biasing the valve actuator away from the valve member is a spring.

28. The equalizing subsurface safety valve of claim 26, wherein the means for biasing the valve actuator away from the valve member is a balancing gas chamber.

29. The equalizing subsurface safety valve of claim 26, wherein the retaining means is a leaf spring.

30. The equalizing subsurface safety valve of claim 26, wherein the retaining means is a simply supported spring.

31. The equalizing subsurface safety valve of claim 26, wherein the retaining means is a spring-loaded washer.

32. The equalizing subsurface safety valve of claim 26, wherein the beam means is a cantilevered beam having a first end and a second end, the first end being secured to the upper surface of the valve member, the second end being disposed within the downward path of the valve actuator, and a portion of the beam being positioned directly above the equalizing plug.

33. An equalizing subsurface safety valve for controlling fluid flow in a well conduit, comprising:

a body member having a longitudinal bore extending therethrough;

a valve actuator disposed for axial movement within the longitudinal bore;

a piston disposed within the body member and moveable in response to application of hydraulic fluid to move the valve actuator within the longitudinal bore;

a curved flapper valve mounted within the body member to control fluid flow through the longitudinal bore, the curved flapper valve having a concave upper surface, a convex lower surface, a bore therethrough, and a longitudinal axis, the concave upper surface having a sealing surface about its periphery;

means for biasing the curved flapper valve to a normally closed position to prevent fluid flow through the longitudinal bore;

means for biasing the valve actuator away from the curved flapper valve;

an equalizing plug disposed for reciprocal movement within the bore of the curved flapper valve;

a retention member secured to the lower surface of the curved flapper valve and biasing the equalizing plug within the bore of the curved flapper valve to a normally closed position; and, a beam for transferring motion of the valve actuator to the equalizing plug, whereby downward movement of the valve actuator is transferred through the beam to the equalizing plug to shift the plug to open a passageway through the curved flapper valve and permit fluid pressure above and below the curved flapper valve to equalize before the curved flapper valve is opened to allow fluid flow through the longitudinal bore.

34. The equalizing subsurface safety valve of claim 33, wherein the equalizing plug is a generally cylindrical plug having an internal fluid flow passageway therethrough and an enlarged annular sealing surface adjacent a first end thereof for cooperable sealing engagement with a sealing surface formed within the bore of the curved flapper valve.

35. The equalizing subsurface safety valve of claim 34, wherein the internal fluid flow passageway includes a generally longitudinal passageway and at least one generally radially disposed opening, the generally longitudinal passageway extending from an upper portion of the plug and disposed in fluid communication with the at least one generally radially disposed opening, the at least one radially disposed opening exiting the plug at a location between the upper portion and the sealing surface of the equalizing plug.

36. The equalizing subsurface safety valve of claim 33, wherein a longitudinal axis of the retention member is aligned parallel to, and directly beneath, the longitudinal axis of the curved flapper valve.

37. The equalizing subsurface safety valve of claim 33, wherein the longitudinal axis of the retention member is aligned perpendicular to the longitudinal axis of the curved flapper valve, and the retention member has a radius of curvature which conforms to the convex lower surface of the curved flapper valve.

38. The equalizing subsurface safety valve of claim 33, wherein the beam is a cantilevered arm having a first end, a second end, and a longitudinal axis, the first end being secured to the upper surface of the curved flapper valve, the second end being disposed within the downward path of the valve actuator, and a portion of the beam being positioned directly above the equalizing plug.

39. The equalizing subsurface safety valve of claim 38, wherein the longitudinal axis of the beam is aligned parallel to, and overlies, the longitudinal axis of the curved flapper valve.

40. The equalizing subsurface safety valve of claim 38, wherein the longitudinal axis of the beam is aligned perpendicular to the longitudinal axis of the curved flapper valve, and the beam has a radius of curvature which conforms to the concave upper surface of the curved flapper valve.

41. The equalizing subsurface safety valve of claim 38, wherein the beam further includes an actuating member extending into the bore through the curved flapper valve and having a lower surface resting upon an upper surface of the equalizing plug.

42. The equalizing subsurface safety valve of claim 41, wherein the upper surface of the equalizing plug is disposed below the concave surface of the curved flapper valve.

* * * * *